US010094341B2

(12) United States Patent
Weigl et al.

(10) Patent No.: US 10,094,341 B2
(45) Date of Patent: Oct. 9, 2018

(54) AIR INTAKE SYSTEM OF AN INTERNAL COMBUSTION ENGINE

(71) Applicant: Continental Automotive Gmbh, Hannover (DE)

(72) Inventors: Manfred Weigl, Sinzing (DE); Philippe Grass, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 212 days.

(21) Appl. No.: 15/029,394

(22) PCT Filed: Oct. 10, 2014

(86) PCT No.: PCT/EP2014/071817

§ 371 (c)(1),
(2) Date: Apr. 14, 2016

(87) PCT Pub. No.: WO2015/055547

PCT Pub. Date: Apr. 23, 2015

(65) Prior Publication Data

US 2016/0265489 A1 Sep. 15, 2016

(30) Foreign Application Priority Data

Oct. 14, 2013 (DE) ..... 10 2013 220 679

(51) Int. Cl.
*F02M 26/00* (2016.01)
*F02M 26/49* (2016.01)
(Continued)

(52) U.S. Cl.
CPC ..... *F02M 26/49* (2016.02); *F02M 26/20* (2016.02); *F02M 26/28* (2016.02); *F02M 26/30* (2016.02);
(Continued)

(58) Field of Classification Search
CPC .. F02M 26/49; F02M 26/46; F02M 35/10222; F02M 26/28; F02M 26/20; F02M 26/35; F02M 26/32; F02M 26/30
See application file for complete search history.

(56) References Cited

U.S. PATENT DOCUMENTS 4,918,923 A * 4/1990 Woollenweber ..... F01N 13/082 123/41.49
6,301,887 B1 * 10/2001 Gorel ..... F01N 3/0222 123/563
(Continued)

FOREIGN PATENT DOCUMENTS

DE 102006058748 A1 6/2008 ..... F02D 21/08
DE 102010048466 A1 4/2012 ..... F02B 29/04
(Continued)

OTHER PUBLICATIONS

German Office Action, Application No. 102013220679.8, 4 pages, dated May 8, 2014.
(Continued)

*Primary Examiner* — Hieu T Vo
*Assistant Examiner* — Sherman Manley
(74) *Attorney, Agent, or Firm* — Slayden Grubert Beard PLLC

(57) ABSTRACT

An air intake system for an internal combustion engine may include an air intake channel, an exhaust gas return channel opening into the air intake channel, an exhaust gas cooler arranged in the exhaust gas return channel, a capture device, and a sensor. The capture device may capture cooling liquid from the exhaust gas cooler in the region of the opening point of the exhaust gas return channel into the air intake channel. The sensor may detect cooling liquid in the capture device.

10 Claims, 1 Drawing Sheet

(51) Int. Cl.

| | |
|---|---|
| ***F02M 35/10*** | (2006.01) |
| ***F02M 26/30*** | (2016.01) |
| ***F02M 26/32*** | (2016.01) |
| ***F02M 26/35*** | (2016.01) |
| ***F02M 26/20*** | (2016.01) |
| ***F02M 26/28*** | (2016.01) |
| ***F02M 26/46*** | (2016.01) |

(52) U.S. Cl.
CPC ..... *F02M 26/32* (2016.02); *F02M 26/35* (2016.02); *F02M 26/46* (2016.02); *F02M 35/10222* (2013.01)

(56) References Cited

U.S. PATENT DOCUMENTS 6,598,388 B2 * 7/2003 Lucas ..... F01N 3/037 55/DIG. 30
7,131,263 B1 * 11/2006 Styles ..... F02M 26/25 123/568.12
8,307,643 B2 * 11/2012 Quinn ..... F02B 29/0468 123/563
8,402,816 B2 3/2013 Rohr ..... 73/40.5 A
9,010,112 B2 * 4/2015 Palm ..... F02B 29/0468 60/599
9,027,341 B2 * 5/2015 Meyer ..... F02B 29/0468 123/542
9,382,836 B2 * 7/2016 Maceroni ..... F02B 33/44
9,702,323 B2 * 7/2017 Paschal ..... F02M 26/35
2008/0264081 A1 * 10/2008 Crowell ..... F28D 7/0091 62/132
2013/0103284 A1 * 4/2013 Gordon ..... F01P 11/16 701/101
2013/0197745 A1 * 8/2013 Skelton ..... G01M 17/007 701/34.4

FOREIGN PATENT DOCUMENTS

FR 2925351 A1 6/2009 ..... B01D 29/92
JP 07238870 A 9/1995 ..... C02F 1/66
WO 2015/055547 A1 4/2015 ..... F02M 25/07

OTHER PUBLICATIONS

International Search Report and Written Opinion, Application No. PCT/EP2014/071817, 15 pages, dated Feb. 17, 2015.

* cited by examiner

AIR INTAKE SYSTEM OF AN INTERNAL COMBUSTION ENGINE

CROSS-REFERENCE TO RELATED APPLICATIONS

This application is a U.S. National Stage Application of International Application No. PCT/EP2014/071817 filed Oct. 10, 2014, which designates the United States of America, and claims priority to DE Application No. 10 2013 220 679.8 filed Oct. 14, 2013, the contents of which are hereby incorporated by reference in their entirety.

TECHNICAL FIELD

The present disclosure concerns an air intake system of an internal combustion engine and a method for detecting a cooling liquid leak.

BACKGROUND

In air intake systems with cooled exhaust gas recirculation, when leaks occur in the exhaust gas cooler, cooling liquid can enter the intake air. This can damage the engine even before the leak is detected via an indication of coolant loss. Detection of such a leak may prevent the potential damage.

Previously, a leak in the cooling system has been detected exclusively by the fall in level of coolant in the expansion tank. For this, systems are used which monitor the level in the expansion tank or in the radiator via electrodes.

SUMMARY OF THE INVENTION

The present disclosure teaches an air intake system for use with an internal combustion engine in which a cooling liquid leak from an exhaust gas cooler can be detected particularly easily and reliably. In some embodiments of the air intake system, a capture device for cooling liquid from the exhaust gas cooler is arranged in the air intake channel in the region of the opening point of the exhaust gas return channel into the air intake channel, wherein a sensor device for detecting cooling liquid in the capture device is assigned to said capture device.

With the air intake system configured according to the teachings of the present disclosure, the entry of cooling liquid into the intake air is thus detected directly. By arranging a capture device for cooling liquid from the exhaust gas cooler in the intake system downstream of the exhaust gas cooler, it is ensured that cooling liquid which reaches the intake system from the cooler is collected.

During engine operation however, it becomes difficult to detect cooling liquid in the intake air after the exhaust gas recirculation, or even in the exhaust gas before the point of entry of the exhaust gas into the intake air, because the gas mass flows are high in comparison with the coolant leakage quantity. A further problem is that the exhaust gas may contain water and a number of contaminants both in the gaseous phase and in condensed form.

During engine operation, because of the gas speed, no fluid collects in the intake channel. However when the engine is switched off, as long as the cooling liquid is still hot and hence a positive pressure is present in the cooling system, fluid continues to escape from any leakage point and can collect in the capture device provided according to the invention. By means of a suitable sensor, it is now checked whether cooling liquid has collected. The sensor device may distinguish cooling liquid from condensate from the exhaust gas or the intake air, since in principle engine operating conditions are possible which could lead to condensate in the intake system. Such cases should not be falsely interpreted as leaks.

The cooling liquid capture device may include a recess in the air intake channel as a depression below the opening point of the exhaust gas return channel into the air intake channel. The recess or depression may have as small a volume as possible, in order to obtain adequate filling with cooling liquid even from small leaks, while the path for the sensor measurement is sufficiently long to achieve an adequate signal resolution.

Due to the suitable geometric design of the detection volume, it is achieved that no significant quantities of condensate are collected during engine operation, so that on engine stoppage, under all conditions, when a leak is present, there is a detectable quantity of cooling liquid.

The sensor may include an ultrasonic sensor device configured to detect the presence of glycol. Glycol (ethylene glycol) is added to the cooling water of the exhaust gas cooler as an antifreeze. The cooling liquid circulating in the exhaust gas cooler is therefore normally a mixture of cooling water and ethylene glycol.

An ultrasonic sensor device is a suitable sensor device for measuring the concentration of glycol in the water by means of interval timing. Since normally around 50% ethylene glycol is added to the cooling water as an antifreeze, the cooling liquid is reliably detected and distinguished from condensate in all conceivable conditions.

Various embodiments of the capture device according to the teachings of the present disclosure ensure that no significant quantities of condensate are collected during engine operation, so that on engine shutdown, under all conditions, when a leak is present, there is a detectable concentration of glycol in the detection volume. Since even a few percent of glycol in water can be detected by means of ultrasonic sensor systems, but no glycol is present either in the intake air or in the exhaust gas, detection of a cooling liquid leak is very reliable.

In some embodiments, the ultrasonic sensor device comprises an ultrasonic converter arranged on the one side of the cooling liquid capture device, in particular the recess or depression. The ultrasonic converter may be located in a flattening of the recess. The ultrasonic signal is here reflected from the opposite wall. To extend the path in small fluid volumes, a geometry with multiple reflections may be selected.

The present teaching also teaches various methods for detecting a cooling liquid leak from an exhaust gas cooler arranged in an exhaust gas return channel of the air intake system of an internal combustion engine. An example method comprises the following steps:

capture of cooling liquid leaking from the exhaust gas cooler in a capture device arranged in the region of the opening point of the exhaust gas return channel into the air intake channel of the air intake system;

detection by a sensor of the cooling liquid collected in the capture device; and confirmation of a cooling liquid leak on detection of cooling liquid.

The method may be carried out when the internal combustion engine is not in operation. The cooling liquid, especially the presence of glycol in the cooling liquid, may be detected by means of an ultrasonic sensor system.

It is possible to distinguish cooling liquid from condensate in the exhaust gas or in the intake air. By performing the measurement immediately after shutdown of the engine, any escaping cooling liquid is virtually undiluted and measured in the liquid phase, which reduces the requirements for sensor sensitivity by several orders of magnitude.

Liquid can be collected in the cooling liquid capture device when the engine is switched off. Under certain conditions (temperature and moisture), this liquid may be condensate from the mixture of fresh air and exhaust gas. During engine operation, the cooling liquid capture device is flushed by the gas flow so that only little fluid can collect. When the engine is switched off however, despite an intact cooler, moisture may still be collected while the engine cools down. If the liquid quantity is sufficient to fill the liquid capture device, the sensor device can measure the ultrasound speed in this liquid. Since however the concentration of glycol is 0%, no leak of the cooling system is reported. The contamination of the condensate by exhaust gas components is negligible in relation to the sound speed, but where required could be compensated by simple correction functions.

If cooling liquid enters the exhaust gas return path, this collects in the capture device and causes a relatively high concentration of glycol. This is measured by means of ultrasonic interval timing and gives information on the leakage of the exhaust gas cooler. In this phase, cooling liquid can escape from a leak after switching off the engine because, when heated by engine operation, a positive pressure builds up in the cooling system. This positive pressure falls again as the engine cools, whereby the time constant is however sufficiently high to allow reliable diagnosis.

BRIEF DESCRIPTION OF THE DRAWINGS

The invention is now explained in more detail below with reference to an exemplary embodiment in connection with the drawing. This shows.

DETAILED DESCRIPTION

Figure 1:
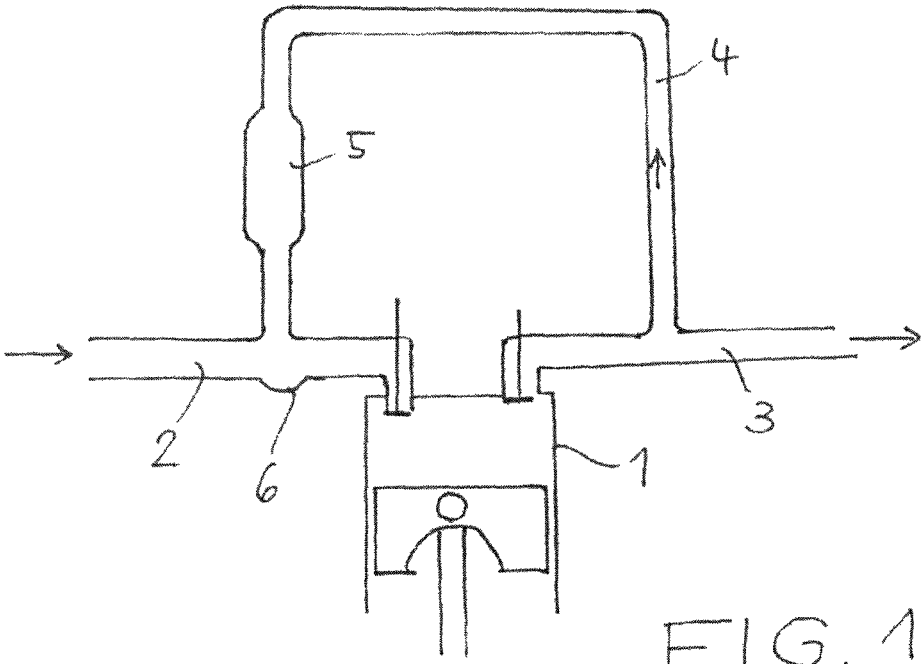
FIG. 1 diagrammatically, the gas exchange system of an internal combustion engine.

In the system shown diagrammatically in FIG. 1, a working cylinder 1 is shown which draws in fresh air via an air intake channel (intake pipe) 2, which air is mixed with exhaust gas from an exhaust gas return channel 4. The exhaust gas is cooled in an exhaust gas cooler 5. The exhaust gas return channel 4 branches from an exhaust gas channel 3 of the working cylinder 1.

In the air intake channel 2, in the region of the opening point of the exhaust gas return channel 4 into the air intake channel 2, a capture device for cooling liquid from the exhaust gas cooler 5 is provided in the form of a recess 6. This recess 6 is a depression which is arranged in the region of the opening point of the exhaust gas return channel 4, slightly offset in the direction of the working cylinder 1.

Figure 2:
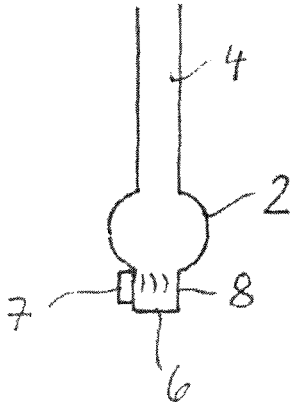
FIG. 2 diagrammatically, a cross-section through the air intake channel with cooling liquid capture device.

FIG. 2 shows a diagrammatic cross-section through an air intake channel 2 with the recess 6 which is located below the inlet point (slightly offset) of the exhaust gas return channel 4. The recess 6 is configured such that the volume is kept as small as possible, in order to obtain an adequate filling even on small leaks. A sensor device for detecting cooling liquid in the recess 6 is assigned to the recess 6, of which device an ultrasonic converter is depicted diagrammatically, located on a flattening of the recess 6. The ultrasound signal emitted by the ultrasonic converter 7 is reflected by the opposite wall 8 of the recess 6 and received again by the converter 7. In this way, a corresponding interval time is measured. The presence of glycol inside the recess 6 and hence a leak in the cooler 5 can be concluded depending on the interval time measured.

What is claimed is:

1. An air intake system for an internal combustion engine, the air intake system comprising:

an air intake channel feeding outside air into a working cylinder of the internal combustion engine, an exhaust gas return channel feeding exhaust air from the working cylinder into a connection with the air intake channel, an exhaust gas cooler arranged in the exhaust gas return channel upstream of the connection, a capture device for cooling liquid from the exhaust gas cooler, the capture device disposed in the air intake channel downstream of the connection, and a sensor for detecting cooling liquid in the capture device.

2. The air intake system as claimed in claim 1, wherein the cooling liquid capture device includes a recess in the air intake channel.

3. The air intake system as claimed in claim 2, wherein the recess includes a depression below the opening point of the exhaust gas return channel into the air intake channel.

4. The air intake system as claimed in claim 1, wherein the sensor device comprises an ultrasonic sensor device.

5. The air intake system as claimed in claim 1, wherein:

the cooling liquid comprises a mixture of cooling water and glycol; and the sensor distinguishes between the presence of cooling liquid in the capture device and the presence of condensate.

6. The air intake system as claimed in claim 4, wherein the ultrasonic sensor device comprises an ultrasonic converter arranged on the one side of the cooling liquid capture device.

7. A method for detecting a cooling liquid leak from an exhaust gas cooler arranged in an exhaust gas return channel of the air intake system of an internal combustion engine, the method comprising:

capturing a liquid from the air intake system in a capture device arranged downstream of a connection where the exhaust gas return channel feeds exhaust air from a working cylinder of the internal combustion engine into an air intake channel of the air intake system;

detecting the liquid collected in the capture device; and signaling a cooling liquid leak in response to detection of liquid collected in the capture device.

8. The method as claimed in claim 7, wherein it is carried out when the internal combustion engine is not in operation.

9. The method as claimed in claim 7, wherein the cooling liquid is detected by means of an ultrasonic sensor system.

10. The method as claimed in claim 7, further comprising distinguishing between the presence of cooling liquid in the capture device and the presence of condensate in the capture device.

* * * * *